US011186995B2

(12) United States Patent
Warshaw

(10) Patent No.: US 11,186,995 B2
(45) Date of Patent: Nov. 30, 2021

(54) HANDRAIL WALL MOUNT ADAPTER

(71) Applicant: 9220-6820 Quebec Inc., Dorval (CA)

(72) Inventor: William Kell Warshaw, Montreal (CA)

(73) Assignee: 9220-6820 Quebec Inc., Dorval (CA)

( * ) Notice: Subject to any disclaimer, the term of this patent is extended or adjusted under 35 U.S.C. 154(b) by 612 days.

(21) Appl. No.: 16/128,555

(22) Filed: Sep. 12, 2018

(65) Prior Publication Data

US 2019/0078334 A1 Mar. 14, 2019

Related U.S. Application Data

(60) Provisional application No. 62/557,506, filed on Sep. 12, 2017.

(51) Int. Cl.
*E04F 11/18* (2006.01)

(52) U.S. Cl.
CPC ..... *E04F 11/1804* (2013.01)

(58) Field of Classification Search
CPC ... E04F 11/18; E04F 11/1802; E04F 11/1804; E04F 11/1812; F16B 5/0088; F16B 5/02; F16B 5/0233
USPC ..... 256/65.16; 248/231.9, 220.21, 220.22, 248/222.14, 221.1, 201, 304, 309.1
See application file for complete search history.

(56) References Cited

U.S. PATENT DOCUMENTS 2,974,918 A * 3/1961 Voigtlander ..... A47B 57/46 248/201
3,204,898 A * 9/1965 Manning ..... E04F 11/1812 248/516
4,858,875 A * 8/1989 Nielsen ..... A47G 1/215 248/488
6,382,276 B1 * 5/2002 Daniels ..... B27C 5/02 144/1.1
6,718,710 B2 * 4/2004 Platt ..... E04F 11/1814 52/296
6,805,335 B2 * 10/2004 Williams ..... E04F 11/181 256/67
6,860,472 B2 * 3/2005 Striebel ..... E04F 11/1817 256/65.03
6,893,199 B2 * 5/2005 Michels ..... F16B 5/02 411/340

(Continued)

FOREIGN PATENT DOCUMENTS

EP 2772596 A2 * 9/2014 ..... E04F 11/1812
GB 2538262 A * 11/2016 ..... E04F 11/1812

*Primary Examiner* — Amber R Anderson
*Assistant Examiner* — Alexus Camero
(74) *Attorney, Agent, or Firm* — Reising Ethington P.C.

(57) ABSTRACT

A handrail wall mount adapter for mounting a handrail wall mounting bracket of a handrail assembly to a wall, the bracket including a mounting plate having a plurality of mounting openings, the adapter comprising: a body having at least one unthreaded opening for receiving a wall mounting fastener and a plurality of bracket mounting openings for receiving at least one bracket mounting fastener, the body being selectively positionable relative to the mounting plate in a first orientation in which the at least one unthreaded opening is aligned with the mounting openings to allow the mounting fasteners to extend through the mounting openings and through the unthreaded openings and securely engage the wall, and in a second orientation in which the bracket mounting openings are aligned with the mounting openings of the mounting plate to secure the mounting bracket to the adapter using the bracket mounting fasteners.

20 Claims, 17 Drawing Sheets

(56) References Cited

U.S. PATENT DOCUMENTS 7,125,002 B2 * 10/2006 Platt ..... E04H 17/1417 256/65.04
7,533,506 B2 * 5/2009 Platt ..... E04H 12/2261 52/296
7,631,409 B2 * 12/2009 Dehlsen ..... E04H 12/2238 256/24
8,117,798 B2 * 2/2012 Bergman ..... E04H 12/2253 52/745.17
8,128,043 B2 * 3/2012 Walter ..... A47B 96/061 248/224.7
9,863,576 B1 * 1/2018 Cifers ..... F16B 35/06
10,450,758 B2 * 10/2019 Burt ..... E04F 11/1836
10,868,413 B1 * 12/2020 Anshu ..... H02G 3/18
2006/0175594 A1 * 8/2006 Burkart ..... E04F 11/1817 256/65.02
2008/0078904 A1 * 4/2008 Trimble ..... E04F 11/1804 248/251
2010/0108969 A1 * 5/2010 Platt ..... E04F 11/1836 256/65.04
2012/0043441 A1 * 2/2012 Yan ..... G01D 11/30 248/222.14
2012/0248166 A1 * 10/2012 Gold ..... F16M 11/14 224/545
2013/0292624 A1 * 11/2013 Bergman ..... E04H 17/1417 256/65.03
2014/0217347 A1 * 8/2014 Green ..... E04F 11/1814 256/66
2015/0354766 A1 * 12/2015 Townsend, Jr. ..... E01F 9/658 362/370

* cited by examiner

HANDRAIL WALL MOUNT ADAPTER

RELATED PATENT APPLICATION

The present application claims the benefit from U.S. Provisional Application No. 62/557,506, the specification of which is incorporated herein by reference.

TECHNICAL FIELD

The technical field generally relates to handrails, and more precisely to wall mount adapters for handrail wall mounting brackets.

BACKGROUND

Handrails are adapted to be grasped by the hand of a user to provide stability or support to the user. Handrails are commonly used on stairways, but can also be used in leveled areas such as along a corridor.

When the handrail is disposed along a wall, the handrail is usually mounted to the wall by a generally L-shaped bracket which connects to the underside of the handrail to allow a hand of the user to grip the handrail from above.

When mounting the handrail to the wall, the user may want to position the handrail at a certain distance from the wall, or may be required to do so by local legislation. For example, local legislation may require the handrail to be at a minimum distance of 38 mm from the wall. According to other legislation, the handrail may be required to be at a minimum distance of 57 mm from the wall.

Once the handrail is installed to the wall, the user may want to move the handrail away from the wall, to conform to a change in legislation for example, or to replace the handrail with a handrail with different dimensions. In this case, the user would unfortunately have to replace all of the brackets with brackets of different dimensions.

Furthermore, the wall surface to which the handrail is mounted may not be even. For example, certain features of the wall may create depressions on the wall surface, thereby creating the need for different brackets with different dimensions to support the handrail along its entire length, which creates additional costs for the user and for the manufacturer.

In some cases, the bracket may also be adapted to receive screws such as decorative screws which may not be sufficiently strong to properly secure the bracket to the wall. In these cases, the user may use additional securing fasteners such as toggle bolts, wall anchors, expansion bolts, lag bolts, masonry screws or the like to secure the bracket, which would detract from the appearance of the brackets and/or handrail if left exposed.

There is therefore a need for a device which would overcome at least one of the above-identified drawbacks.

SUMMARY

According to one aspect, there is provided a handrail wall mount adapter for mounting a handrail wall mounting bracket of a handrail assembly to a wall, the bracket including a mounting plate having a plurality of mounting openings extending therethrough, the adapter comprising: a body having a front face configured for matingly receiving the mounting plate and a rear face for abutting the wall, the body further having at least one unthreaded opening extending between the front face and the rear face of the body, each unthreaded opening being configured for receiving a wall mounting fastener therethrough, the body further having a plurality of bracket mounting openings defined in the front face for receiving at least one bracket mounting fastener, the body being selectively positionable relative to the mounting plate in a first orientation in which the at least one unthreaded opening is aligned with the mounting openings of the mounting plate to allow the mounting fasteners to extend through the mounting openings and through the unthreaded openings and securely engage the wall, and in a second orientation in which the bracket mounting openings are aligned with the mounting openings of the mounting plate to allow the bracket mounting fasteners to extend through the mounting openings and the bracket mounting openings to thereby secure the mounting bracket to the adapter.

In one embodiment, each bracket mounting opening includes a threaded bore to threadably receive the bracket mounting screws.

In one embodiment, the first, second and third bracket mounting bores are unthreaded and the bracket mounting screws include self-tapping screws.

In one embodiment, the at least one unthreaded opening includes a plurality of offcentered unthreaded holes disposed around a center of the front face.

In one embodiment, the plurality of offcentered unthreaded holes includes first, second and third offcentered unthreaded holes.

In one embodiment, the at least one unthreaded opening includes a central unthreaded hole centered on the front face.

In one embodiment, the first, second and third offcentered unthreaded holes have the same diameter and the central unthreaded hole has a diameter larger than the diameter of the offcentered unthreaded holes.

In one embodiment, each unthreaded opening is counterbored.

In one embodiment, each unthreaded opening includes a cylindrical recess extending from the front face towards the rear face and a bore extending from the cylindrical recess towards the rear face.

In one embodiment, the body further includes a front recess which extends into the body from the front face towards the rear face and which defines a front peripheral edge surrounding the front recess, the front recess being sized and shaped to receive the mounting plate.

In one embodiment, the body further includes a body sidewall extending between the front and rear faces, the body sidewall being tapered from the rear face towards the front face.

In one embodiment, the body is hollow.

In one embodiment, the front face of the body is closed and the rear face is open.

In one embodiment, the body further includes a rear peripheral edge facing away from the front face for abutting the wall.

In one embodiment, the body further includes a rear lip extending along the inside of the body sidewall near the rear peripheral edge, the rear lip being configured for abutting a front peripheral edge of an additional adapter to allow the adapter to be stacked over the additional adapter.

In one embodiment, the body is rectangular.

According to another aspect, there is also provided a kit for mounting a handrail wall mounting bracket of a handrail assembly to a wall, the bracket including a mounting plate having a plurality of mounting openings extending therethrough, the kit comprising: a first handrail wall mount adapter as described above; and a second handrail wall mount adapter as described above, the second adapter being selectively stackable over the first adapter such that the rear face of the second handrail wall mount adapter engages the front face of the first handrail wall mount adapter and each unthreaded openings of the second handrail wall mount adapter is aligned with a corresponding bracket mounting opening of the first handrail wall mount to receive a corresponding adapter mounting screw therethrough.

In one embodiment, the body of each one of the first and second handrail wall mount adapters further includes a body sidewall extending between the front and rear faces of the corresponding body, the body sidewall being tapered from the rear face towards the front face.

In one embodiment, the body of the second handrail wall mount adapter includes a rear peripheral edge facing away from the front face for abutting the wall and a rear lip extending along the inside of the body sidewall near the rear peripheral edge, the rear lip being configured for abutting a front peripheral edge of the first handrail wall mount adapter.

According to yet another aspect, there is also provided a handrail wall mount adapter for mounting a handrail wall mounting bracket of a handrail assembly to a wall, the bracket including a mounting plate having a plurality of mounting openings adapted to receive mounting fasteners therethrough, the adapter comprising: a body having a front face configured for matingly receiving the mounting plate and a rear face for abutting the wall, the body being positionable relative to the mounting plate in a first portion and a second position, the body further having: at least one unthreaded opening extending between the front face and the rear face of the body for receiving the mounting fasteners therethrough, the at least one unthreaded opening being disposed on the body such that when the adapter is in a first orientation relative to the mounting plate, the at least one unthreaded opening is aligned with the mounting openings of the mounting plate to allow the mounting fasteners to extend through the mounting openings and through the unthreaded openings and securely engage the wall; and a plurality of bracket mounting openings defined in the front face for receiving at least one bracket mounting fastener, the bracket mounting openings being disposed on the body such that when the adapter is in a second orientation relative to the mounting plate, the bracket mounting openings are aligned with the mounting openings of the mounting plate to allow the bracket mounting fasteners to extend through the mounting openings and the bracket mounting openings to thereby secure the bracket to the adapter.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

It will be appreciated that for simplicity and clarity of illustration, elements shown in the figures have not necessarily been drawn to scale. For example, the dimensions of some of the elements may be exaggerated relative to other elements for clarity.

DETAILED DESCRIPTION

Although the embodiments of the handrail wall mount adapter and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the handrail wall mount adapter, as will be briefly explained herein and as can be easily inferred herefrom by a person skilled in the art.

Moreover, it will be appreciated that positional descriptions such as "front", "rear", "top", "bottom" and the like should be taken in the context of the figures only and should not be considered limiting. More particularly, they correspond to the position and orientation of the handrail wall mounting bracket, when mounted such that it supports a handrail from the underside of the handrail to allow a hand of a user to grab the handrail generally from above the handrail and slide longitudinally along the handrail substantially unimpeded. The rear position corresponds to portions adjacent the wall while the front position corresponds to portions opposed to the wall.

Having discussed the general context of the handrail wall mount adapter, optional embodiments will be discussed further hereinbelow. The embodiments according to the following description are given for exemplification purposes only.

Figure 1:
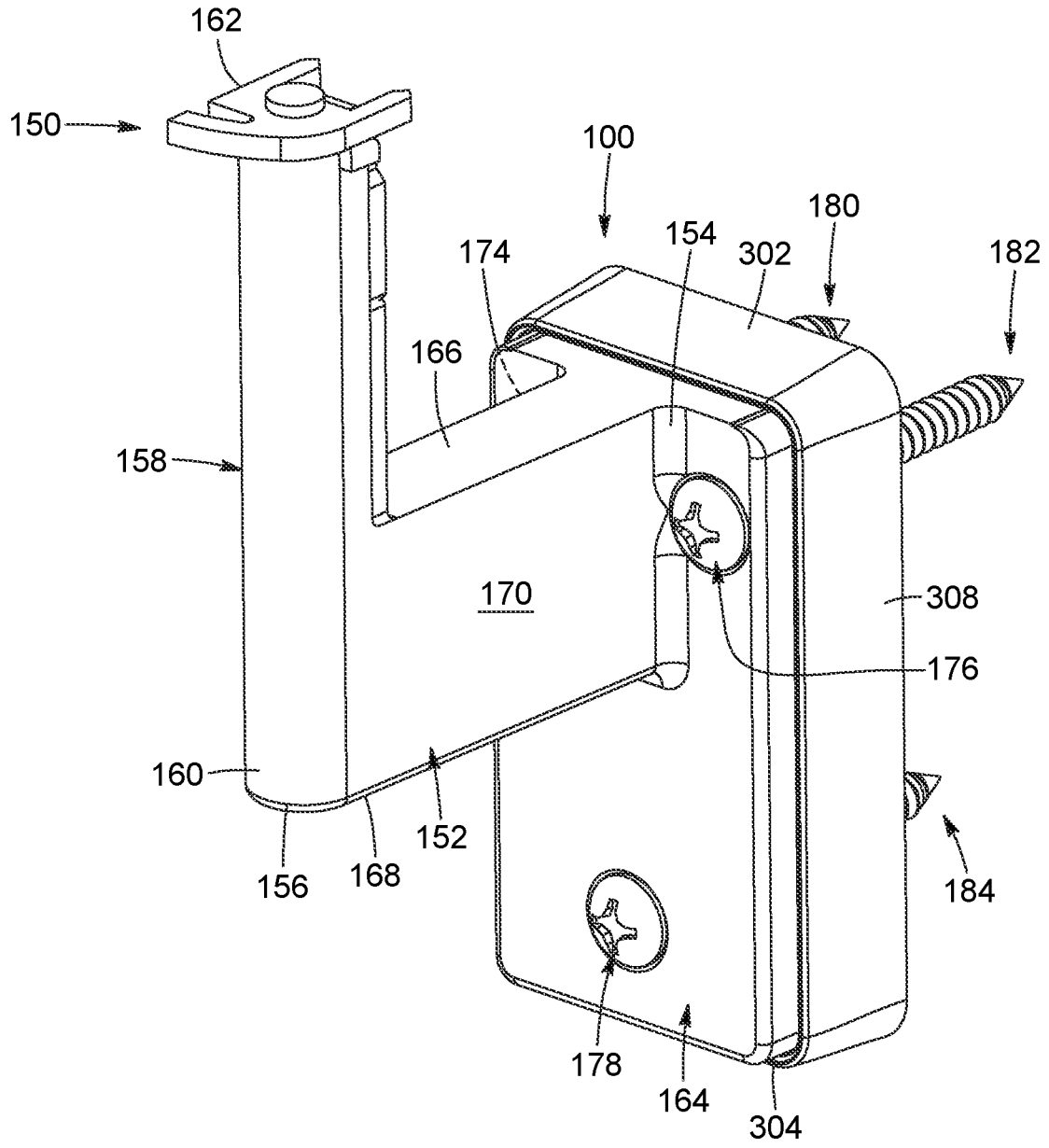
FIG. 1 is a top front perspective view of a handrail wall mount adapter, in accordance with one embodiment, with the adapter connected to a handrail wall mount bracket and shown in a first configuration in which the adapter is adapted to be connected to a wall using two upper wall mounting fasteners and one lower wall mounting fastener.
Figure 2:
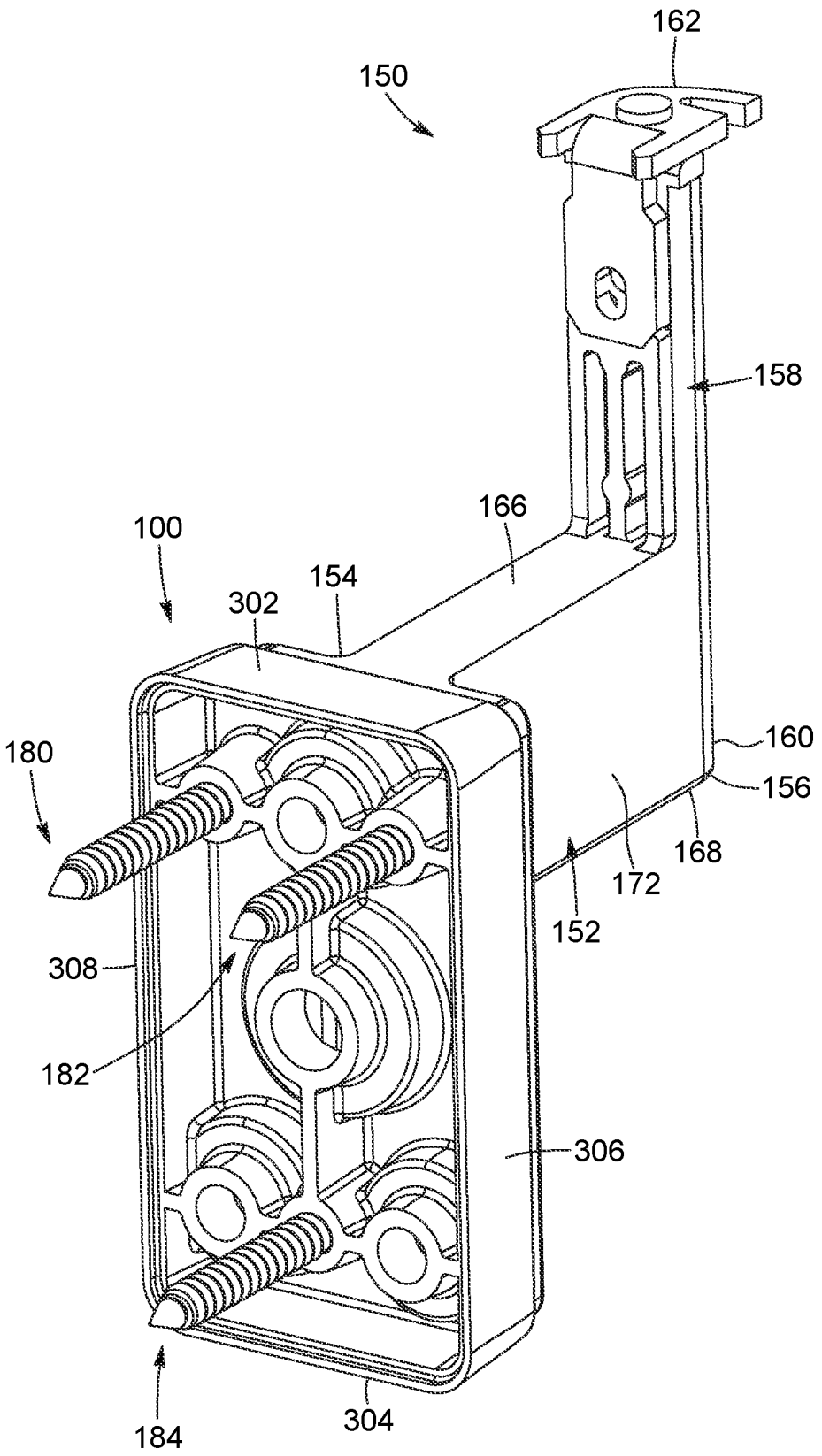
FIG. 2 is a top rear perspective view of the handrail wall mount adapter illustrated in FIG. 1, with the adapter still connected to the handrail wall mount bracket and still shown in the first configuration.
Figure 3:
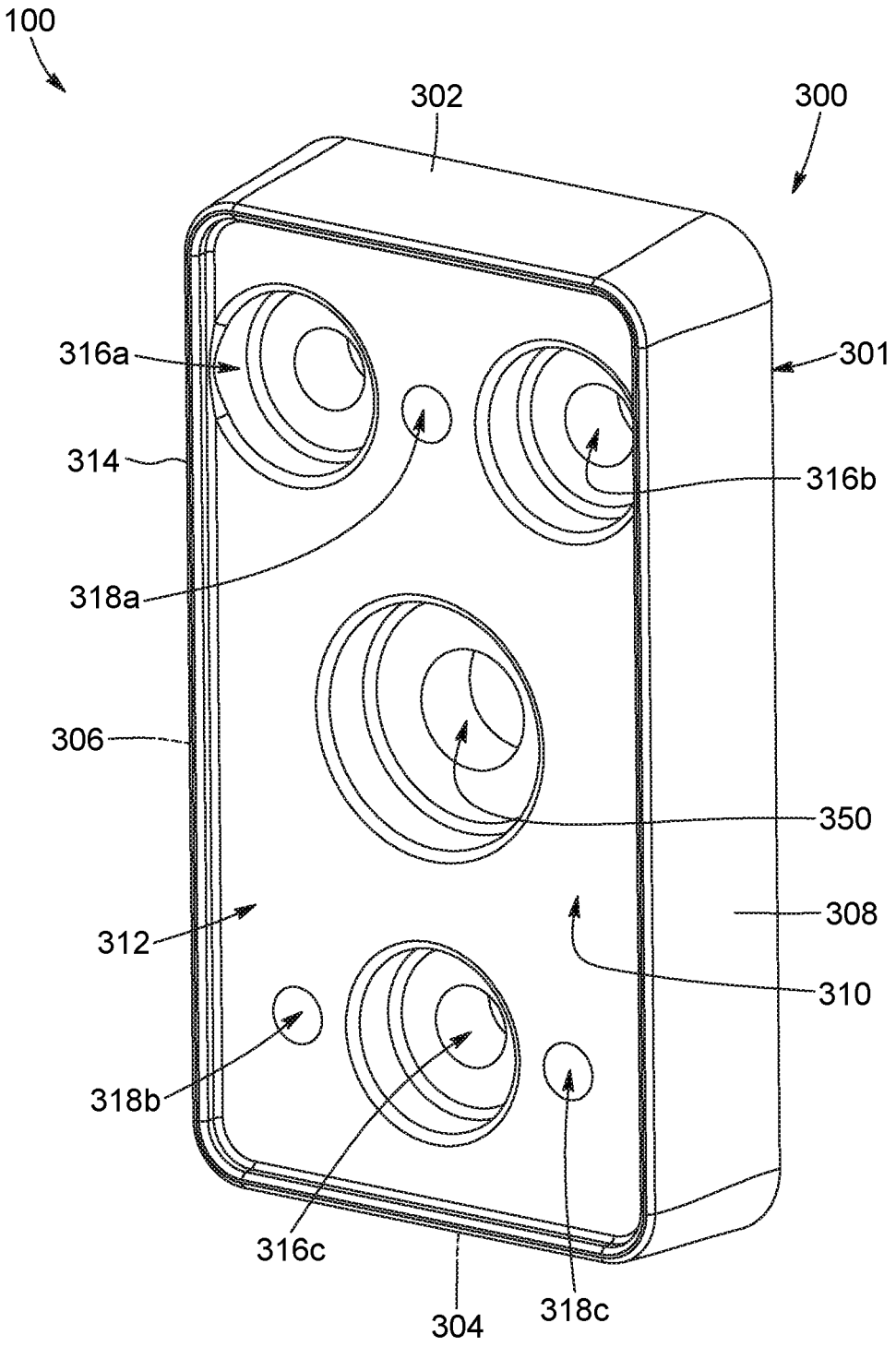
FIG. 3 is a top front perspective view of the handrail wall mount adapter illustrated in FIG. 1, with the adapter shown in isolation.
Figure 4:
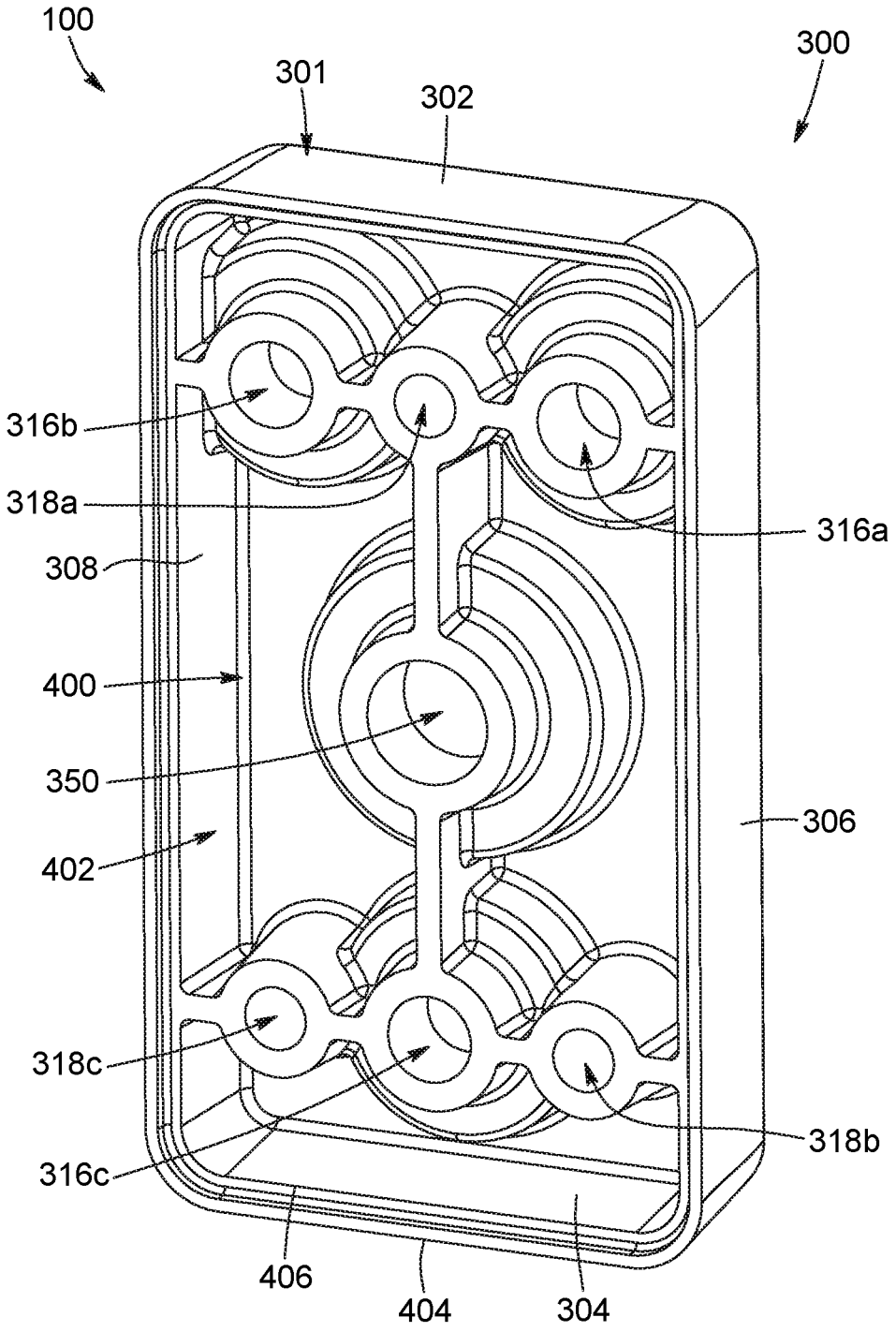
FIG. 4 is a top rear front perspective view of the handrail wall mount adapter illustrated in FIG. 1.
Figure 5:
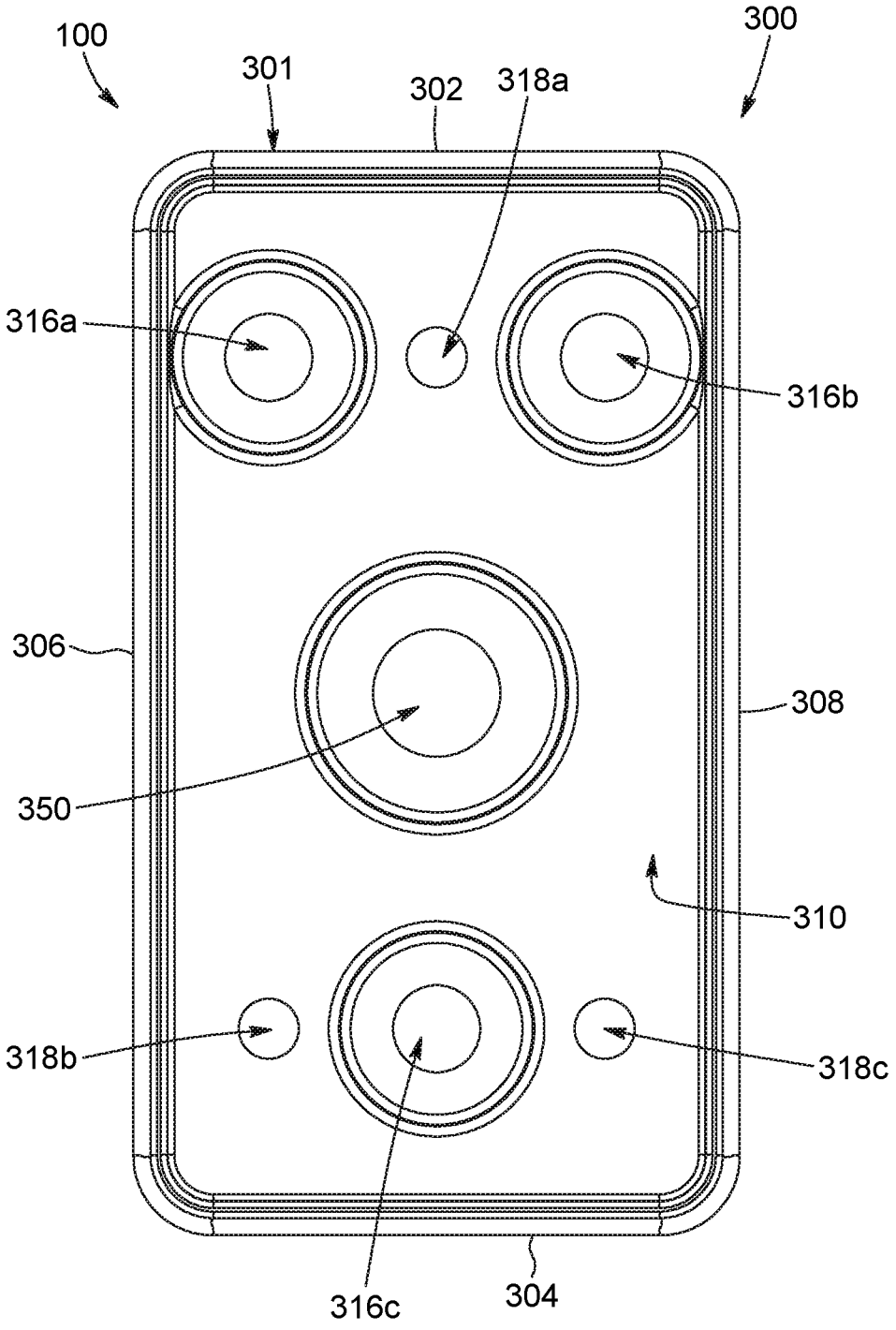
FIG. 5 is a front elevation view of the handrail wall mount adapter illustrated in FIG. 1.
Figure 6:
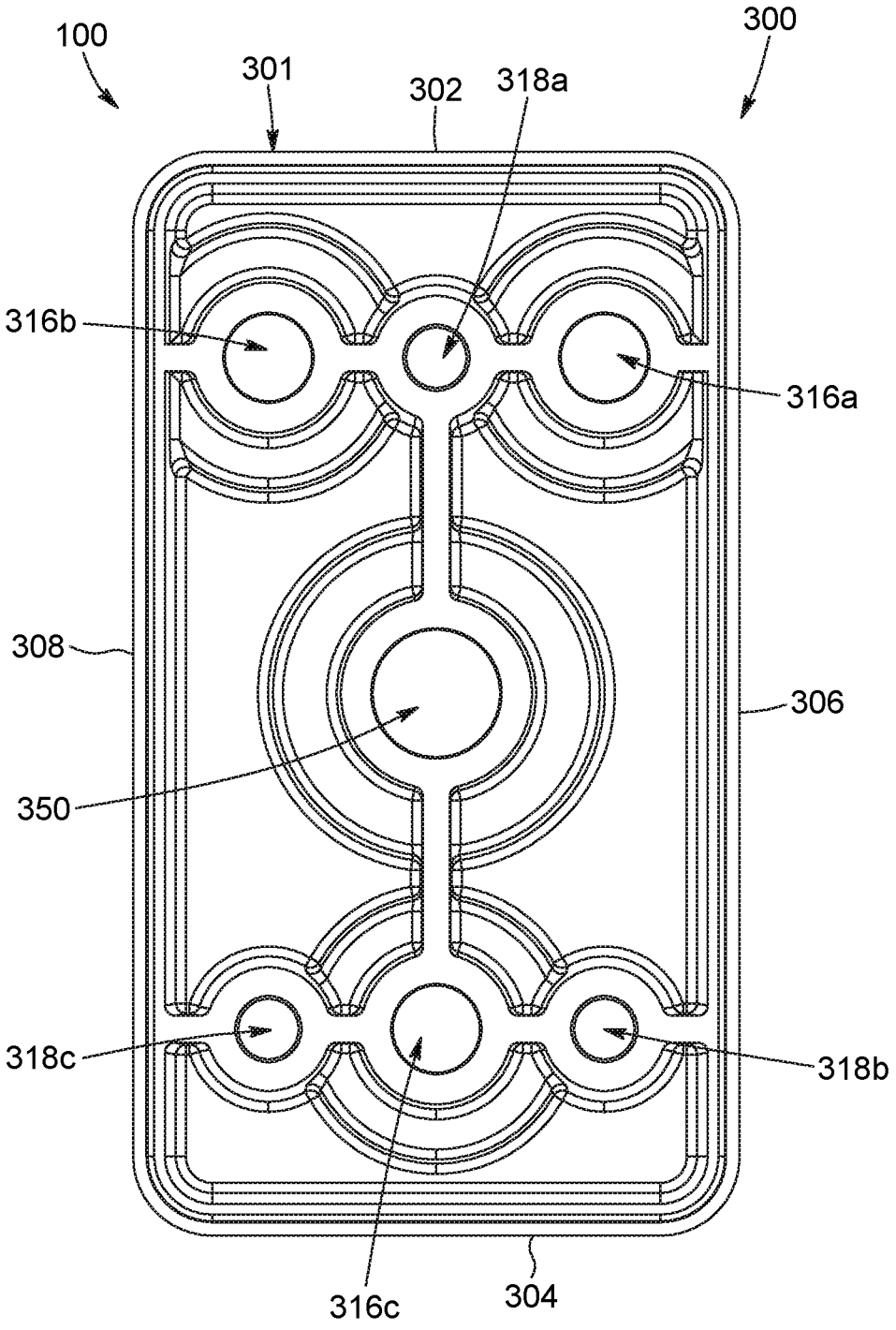
FIG. 6 is a rear elevation view of the handrail wall mount adapter illustrated in FIG. 1.
Figure 7:
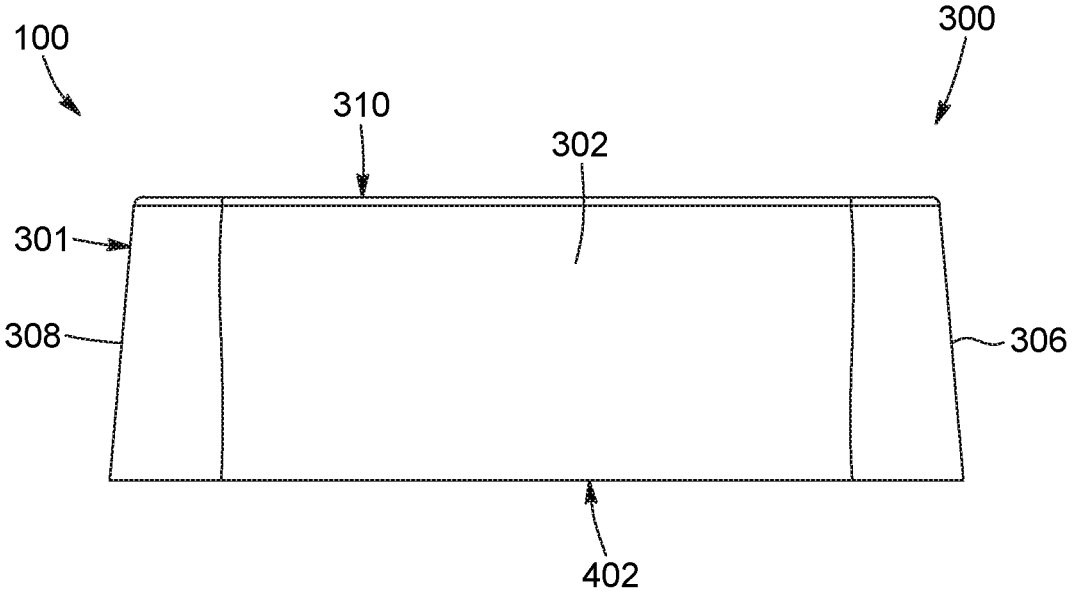
FIG. 7 is a top plan view of the handrail wall mount adapter illustrated in FIG. 1.

Referring first to FIGS. 1 and 2, there is provided a handrail wall mount adapter 100, in accordance with one embodiment. The adapter 100 is configured to attach a handrail wall mounting bracket 150 to a wall. The handrail wall mounting bracket 150 is adapted to support a handrail and to maintain the handrail spaced from the wall such that a user may readily grab and/or hold the handrail.

In the embodiment illustrated in FIGS. 1 and 2, the bracket 150 is generally L-shaped and includes a generally horizontal first elongated portion 152 having a first end 154 and a second end 156 and a generally vertical second elongated portion 158 having a first end 160 secured to the second end 156 of the first elongated portion 152 and a second end 162 adapted to be secured to the underside of the handrail.

The bracket 150 further includes a mounting plate 164 secured to the first end 154 of the first elongated portion 152. The mounting plate 164 is adapted to be placed against and fastened to the adapter 100 to secure the bracket 150 to the adapter 100. Specifically, the mounting plate 164 is generally planar and extends generally vertically and orthogonally to the first elongated portion 152 of the bracket 150.

In the illustrated embodiment, both the mounting plate 164 and the adapter 100 are generally rectangular. Alternatively, the mounting plate 164 and the adapter 100 could have a different shape. It will also be understood that although the mounting plate 164 and the adapter 100 are shown in FIGS. 1 and 2 as having the same shape, the mounting plate 164 and the adapter 100 could instead be shaped differently from each other.

Still in the illustrated embodiment, the first elongated portion 152 of the bracket 150 has a generally rectangular cross-section. Specifically, the first elongated portion 152 includes top and bottom walls 166, 168 which are disposed generally horizontally and parallel to each other, and first and second side walls 170, 172 which are disposed generally vertically and parallel to each other. Still in the illustrated embodiment, the side walls 170, 172 are longer than the top and bottom walls 166, 168, such that the cross-section of the first elongated portion 152 is vertically elongated. It will be understood that this configuration helps prevent the first elongated portion 152 from bending downwardly when a user grabbing the handrail puts his weight down on the handrail. Alternatively, instead of being rectangular, the cross-section of the first elongated portion 152 may instead be circular, oval or have any other shape which a skilled person would consider to be appropriate.

In the illustrated embodiment, the first and second elongated portions 152, 158 of the bracket 150 are angled away from each other at an angle of about 90 degrees. Alternatively, the first and second elongated portions 152, 158 could be disposed at a different angle from each other. Specifically, the first elongated portion 152 may not be exactly horizontal and/or the second elongated portion 158 may not be exactly vertical.

Still in the illustrated embodiment, the mounting plate 164 includes a top left mounting opening or hole 174 disposed to the left of the first elongated portion 152, a top right mounting opening or hole 176 disposed to the right of the first elongated portion 158 and a bottom mounting opening or hole 178 which is located below the first elongated portion 152 and which is generally horizontally centred on the mounting plate 164. Alternatively, the mounting plate 164 could include a different number of holes and/or the holes could be positioned at different locations on the mounting plate 164.

The handrail wall mount adapter 100 is adapted to allow the bracket 150 to be mounted to a wall, not shown, in one of multiple configurations, each configuration using a certain number and/or type of fasteners, as will be further explained below. In the embodiment illustrated in FIGS. 1 and 2, the adapter 100 and the bracket 150 are configured to be mounted to the wall using a top left wall mounting fastener 180 engaging the top left mounting hole 174 of the mounting plate 164, a top right wall mounting fastener 182 engaging the top right mounting hole 176 and a bottom wall mounting fastener 184 engaging the bottom mounting hole 178.

In one embodiment, the top left, top right and bottom mounting holes 174, 176, 178 of the mounting plate 164 are countersunk and the fasteners 180, 182, 184 include countersunk screws having a conical head which are sized and shaped to be received snuggly within the countersunk holes. Alternatively, the mounting holes 174, 176, 178 of the mounting plate 164 could have a different configuration.

Now turning to FIGS. 3 to 8B, the adapter 100 includes a rectangular body 300 with generally rounded corners. The body 300 includes a front face 310, a rear face 402 spaced from the front face 310 and a body sidewall 301 extending between the front and rear faces 310, 402. More specifically, the body sidewall 301 includes a first horizontal wall 302, a second horizontal wall 304 spaced from the first horizontal wall 302, a first vertical side wall 306 and a second vertical side wall 308 spaced from the first vertical side wall 306.

In the illustrated embodiment, the body 300 is generally hollow and defines an inner cavity 400 which is open on one side. Specifically, the front face 310 is closed and the rear face 402 is open. The body 300 further includes a front recess 312 which extends into the body 300 from the front face 310 towards the rear face 402 and a front peripheral edge 314 surrounding the front recess 312. The front recess 312 is sized and shaped to receive the mounting plate 164 of the bracket 150. In the illustrated embodiment, the front recess 312 and the front peripheral edge 314 are rectangular to receive the mounting plate 164 which is also rectangular. Alternatively, the front recess 312 and the front peripheral edge 314 may have another shape corresponding to the shape of the mounting plate 164.

At the rear face 402, the first horizontal wall 302, the second horizontal wall 304, the first vertical side wall 306 and the second vertical side wall 308 define a rectangular rear peripheral edge 404 which faces rearwardly, away from the front face 310, and which is adapted to abut the wall to which the handrail is secured.

It will be appreciated that this configuration allows the body 300 to be manufactured by molding using a moldable material such as a plastic or a die-castable metal such as zinc, aluminium or the like. Alternatively, the body 300 could instead be solid and be manufactured by machining from a metal, for example, in which case the body 300 may include a closed rear face.

In the illustrated embodiment, the body sidewall 301 is tapered from the rear face 402 towards the front face 310. Specifically, the first horizontal wall 302 and the second horizontal wall 304 are not disposed in planes which are parallel to each other, but are instead angled towards a center of the front face 310. Similarly, the first vertical side wall 306 and the second vertical side wall 308 are also not disposed in planes which are parallel to each other, but are instead also angled towards a center of the front face 310. More specifically, the first horizontal wall 302 is angled towards the second horizontal wall 304, from the rear face 402 towards the front face 310, and the second horizontal wall 304 is angled towards the first horizontal wall 302, from the rear face 402 towards the front face 310. Similarly, the first vertical side wall 306 is angled towards the second vertical side wall 308 and the second vertical side wall 308 is angled towards the first vertical side wall 306, again from the rear face 402 towards the front face 310.

It will be understood that in this configuration, the front peripheral edge 314 therefore defines a smaller rectangle than the rear peripheral edge 404, which allows the adapter 100 to be stacked over a second, similar adapter, as will be further explained below.

Still in the illustrated embodiment, the body 300 further includes a rectangular rear lip 406 which extends along the inside of the first horizontal wall 302, of the second horizontal wall 304, of the first vertical side wall 306 and of the second vertical side wall 308, near the rear peripheral edge 404. The rear lip 406 is adapted to abut the front peripheral edge 314 of a second, similar adapter when the adapter 100 is stacked over the second, similar adapter, as will be explained further below. Alternatively, in an embodiment in which the rear face 402 is closed instead of being open, the body 300 could instead include a rear recess which would be generally similar to the front recess 312 and which would extend into the body 300 from the rear face 402 towards the front face 310.

Still referring to FIGS. 3 to 8B, the body 300 further includes plurality of bores or holes 316*a*, 316*b*, 316*c* extending through the body 300 perpendicularly to the front face 310. In the illustrated embodiment, the holes 316*a*, 316*b*, 316*c* are generally offcentered relative to the front face 310. In other words, the holes 316*a*, 316*b*, 316*c* are generally disposed around a center of the front face 310. More specifically, the plurality of bores includes a first counterbored hole 316*a* which is located generally towards the first horizontal wall 302 and the first vertical side wall 306, a second counterbored hole 316*b* which is located generally towards the first horizontal wall 302 and the second vertical side wall 308 and a third counterbored hole 316*c* which is located generally towards the second horizontal wall 304 and which is generally centered horizontally between the first and second vertical side walls 306, 308.

Figure 8A:
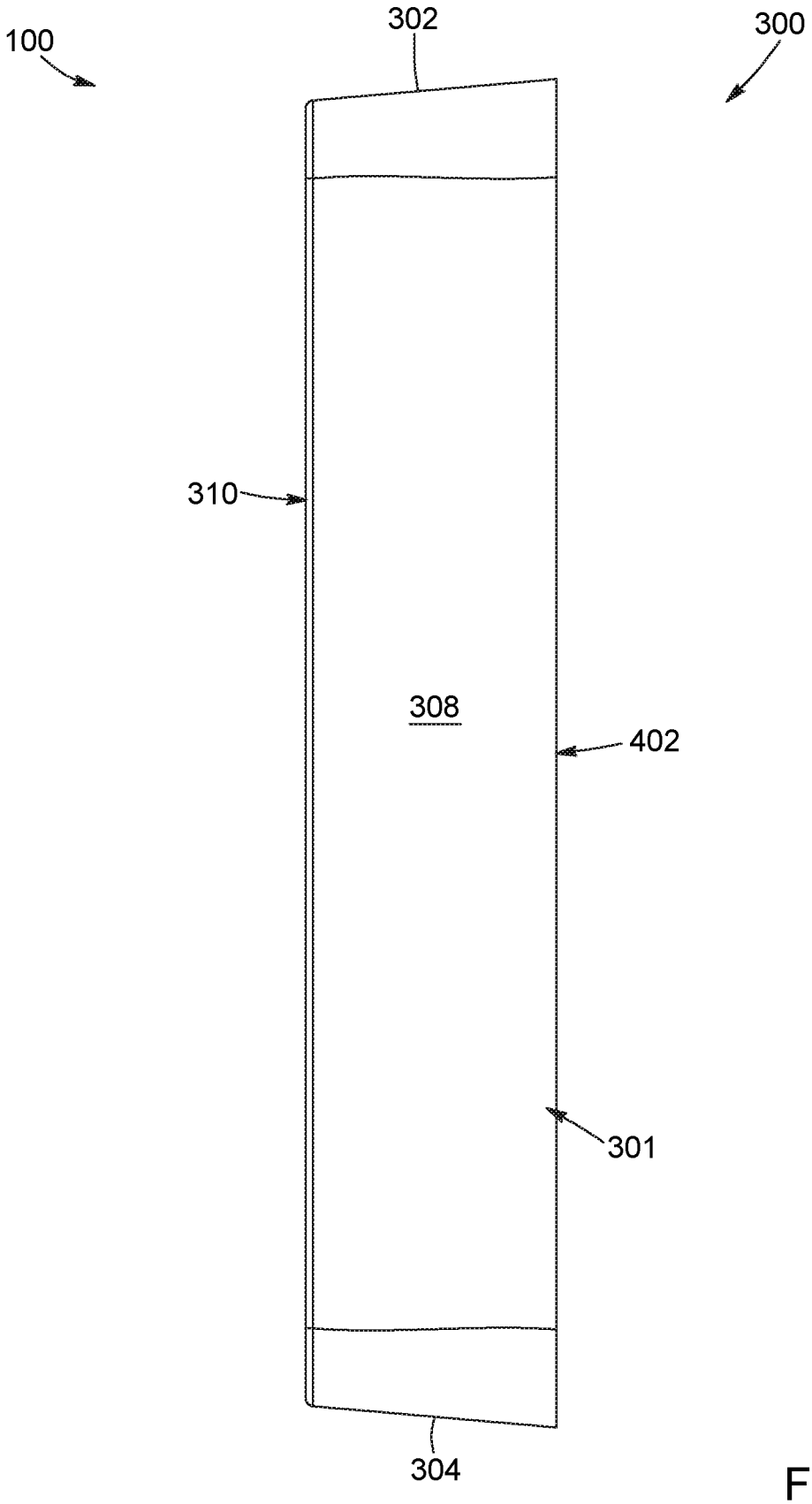
FIG. 8A is a side elevation view of the handrail wall mount adapter illustrated in FIG. 1.
Figure 8B:
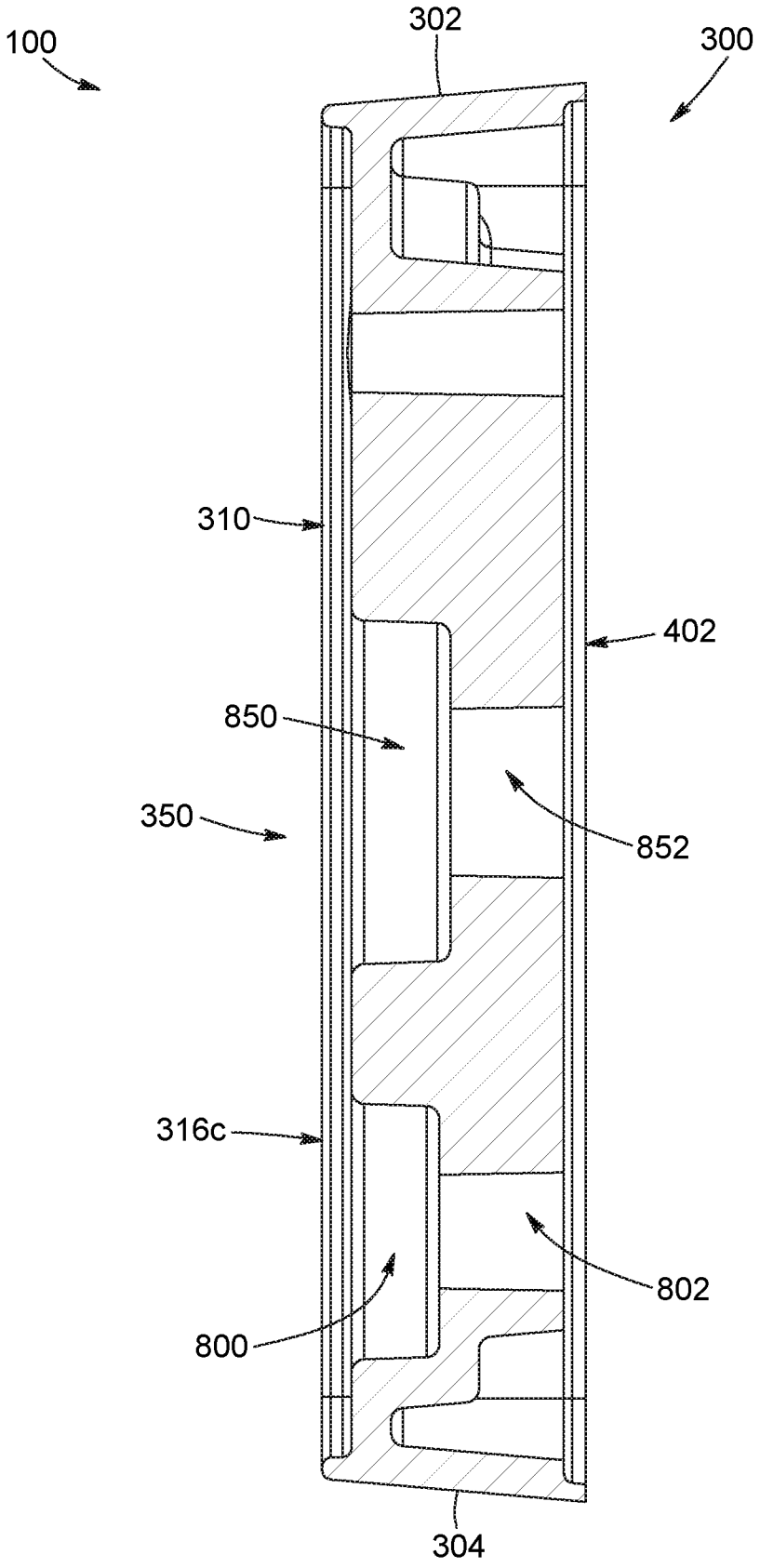
FIG. 8B is a cross-section view of the handrail wall mount adapter illustrated in FIG. 1.

As best shown in FIG. 8B, each counterbored hole 316*a*, 316*b*, 316*c* includes a cylindrical recess 800 extending from the front face 310 towards the rear face 402 of the adapter 100 and a bore 802 extending from the cylindrical recess 800 away from the front face 310 and towards the rear face 402. The cylindrical recess 800 is adapted to receive a head of the corresponding fastener and the bore 802 is adapted to receive a body of the fastener.

In the illustrated embodiment, the bore 802 is unthreaded to allow the corresponding fastener to simply extend therethrough and engage the wall against which the adapter 100 is placed.

Referring back to FIGS. 1 and 2, the adapter 100 is shown ready to be mounted to the wall in a first configuration, in which the adapter 100 is positioned and oriented such that the first vertical side wall 306 is disposed to the left of the second vertical side wall 308 and the first horizontal wall 302 is disposed above the second horizontal wall 304.

In the illustrated embodiment, the first, second and third counterbored holes 316*a*, 316*b*, 316*c* are further positioned on the front face 310 such that, in this orientation, they are in alignment respectively with the top left, top right and bottom mounting holes 174, 176, 178 of the mounting plate 164 when the mounting plate 164 is received in the front recess 312.

In this first configuration, each one of the left, right and bottom fasteners 180, 182, 184 includes a screw which passes through a corresponding one of the top left, top right and bottom mounting holes 174, 176, 178 of the mounting plate 164 and through a corresponding one of the top left, top right and bottom counterbored holes 316*a*, 316*b*, 316*c* of the body 300 to engage the wall and thereby secure the handrail to the wall.

To mount the bracket 150, and therefore the handrail, to the wall in this first configuration, the bracket 150 is first placed over the adapter 100 such that the mounting plate 164 is received in the front recess 312 of the adapter 100. The adapter 100 is then positioned on the wall in a desired location in which the bracket 150 extends to and can be connected to the underside of the handrail.

The fasteners 180, 182, 184 are then inserted in their respective holes of the mounting plate 164 until the head of the fastener 180, 182, 184 abuts the mounting plate 164 to firmly secure the adapter 100 against the wall and the mounting plate 164 of the bracket 150 against the adapter 100. It will be appreciated that in this configuration, both the adapter 100 and the bracket 150 are secured to the wall using only the three fasteners 180, 182, 184.

Referring again to FIGS. 3 to 8B, the body 300 of the adapter 100 further includes a first bracket mounting opening or bore 318*a* located generally towards the first horizontal wall 302 and horizontally between the first and second counterbored holes 316*a*, 316*b*, a second bracket mounting opening or bore 318*b* located near the second horizontal wall 304 and horizontally between the first vertical side wall 306 and the third counterbored hole 316*c* and a third bracket mounting opening or bore 318*c* located near the second horizontal wall 304 and horizontally between the third counterbored hole 316*c* and the second vertical side wall 308. The first, second and third bracket mounting bores 318*a*, 318*b*, 318*c* are disposed generally orthogonally to the front face 310 and therefore parallel to the first, second and third counterbored holes 316*a*, 316*b*, 316*c*.

In the illustrated embodiment, the first, second and third bracket mounting bores 318*a*, 318*b*, 318*c* extend all the way through the body 300 between the front face 310 and the rear face 402. Alternatively, the first, second and third bracket mounting bores 318*a*, 318*b*, 318*c* may be blind such that they only extend partially through the body 300 from the front face 310 towards the rear face 310.

Figure 9:
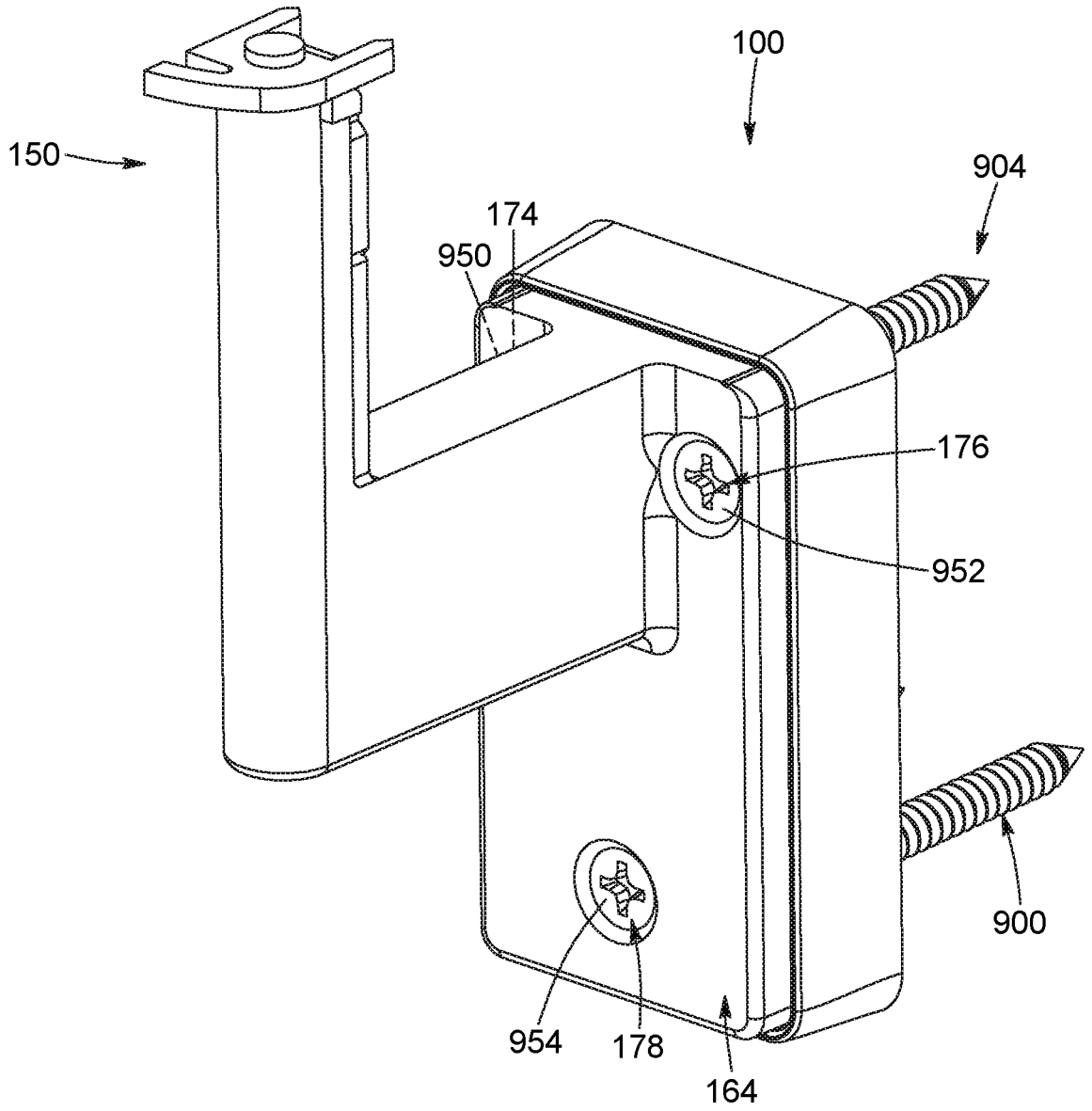
FIG. 9 is a top front perspective view of the handrail wall mount adapter illustrated in FIG. 1, with the adapter connected to a handrail wall mount bracket and shown in a second configuration in which the adapter is adapted to be connected to a wall using one upper wall mounting fastener and two lower wall mounting fasteners.
Figure 10:
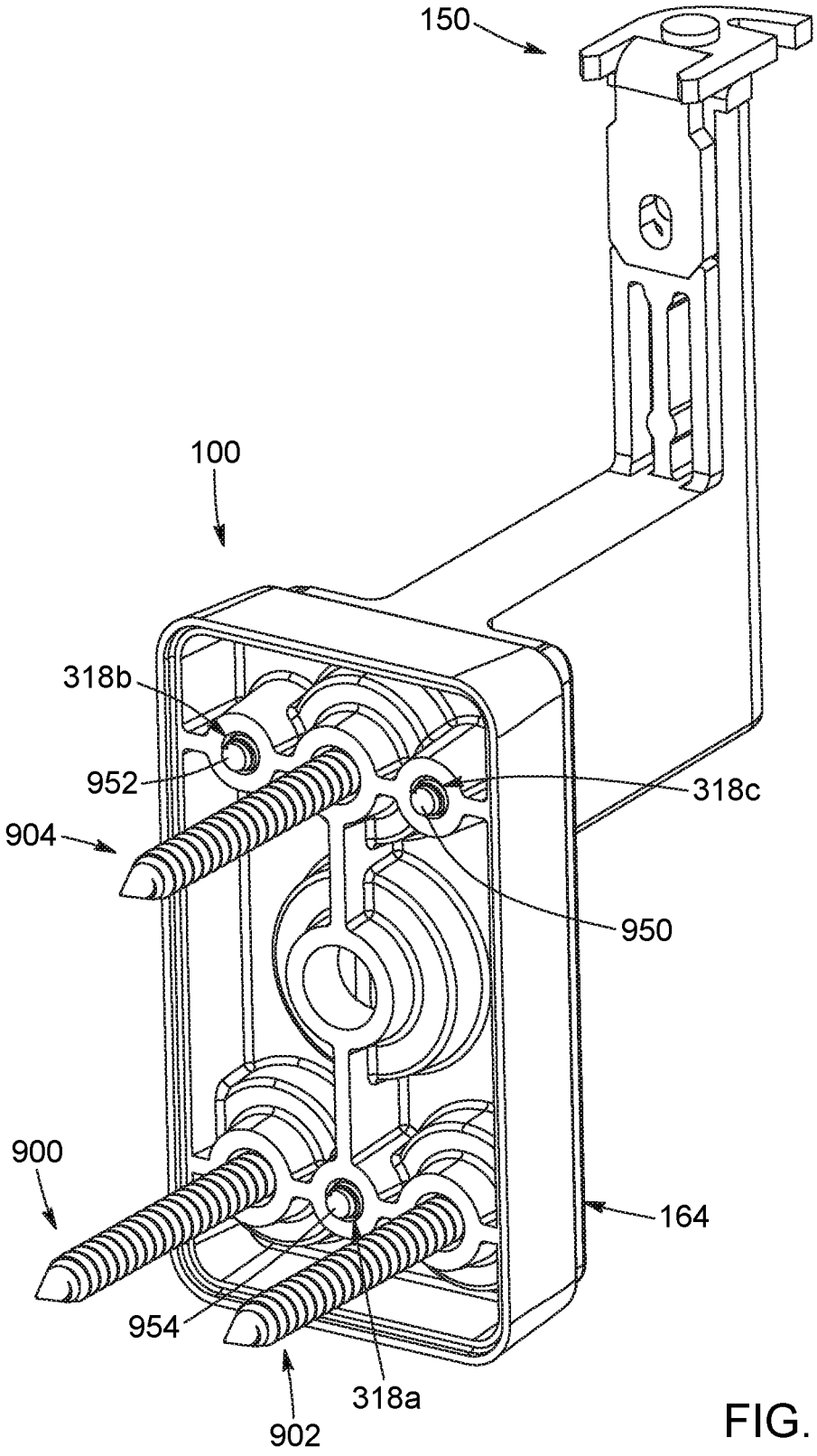
FIG. 10 is a top rear perspective view of the handrail wall mount adapter illustrated in FIG. 9, with the adapter still connected to the handrail wall mount bracket and still shown in the second configuration.

Now referring to FIGS. 9 and 10, the adapter 100 is shown assembled with the bracket 150 in a second configuration, in which the adapter is rotated 180 degrees from the first configuration illustrated in FIGS. 1 and 2. Specifically, the adapter 100 is positioned and oriented such that the first vertical side wall 306 is disposed to the right of the second vertical side wall 308 and the first horizontal wall 302 is disposed below the second horizontal wall 304.

In the illustrated embodiment, the third, second and first bracket mounting bores 318*c*, 318*b*, 318*a* are further positioned on the front face 310 such that, in this orientation, they are in alignment respectively with the top left, top right and bottom mounting holes 174, 176, 178 of the mounting plate 164 when the mounting plate 164 is received in the front recess 312.

In this configuration, the adapter 100 can first be positioned and secured on the wall. Specifically, the first, second and third counterbored holes 316*a*, 316*b*, 316*c* are adapted to respectively receive first, second and third wall mounting screws 900, 902, 904, which can be similar to the left, right and bottom fasteners 180, 182, 184 used with the adapter 100 in the first configuration or which could be shorter.

The adapter 100 is first placed in abutment against the wall at a desired location, and the first, second and third wall mounting screws 900, 902, 904 are inserted into the counterbored holes 316*a*, 316*b*, 316*c* and into the wall beyond the adapter 100 until the head of the screws 900, 902, 904 abuts the adapter 100 and the body of the screws 900, 902, 904 firmly engages the wall, thereby securing the adapter 100 to the wall.

Once the adapter 100 has been secured to the wall, the bracket 150 can then be placed over the adapter 100 such that the mounting plate 164 is received in the front recess 312 of the adapter 100. As explained above, in this position, the top left, top right and bottom mounting holes 174, 176, 178 of the mounting plate 164 are aligned respectively with the third, second and first bracket mounting bores 318*c*, 318*b*, 318*a* of the adapter 100.

The bracket 150 can then be secured to the adapter 100 using first, second and third bracket mounting screws 950, 952, 954, which are adapted to pass through the top left, top right and bottom mounting holes 174, 176, 178 of the mounting plate 164 and to threadably engage the third, second and first bracket mounting bores 318*c*, 318*b*, 318*a* of the adapter 100.

It will be appreciated that since the bracket mounting screws 950, 952, 954 only secure the bracket 150 to the adapter 100, the bracket mounting screws 950, 952, 954 do not need to extend beyond the adapter 100 and can therefore be substantially shorter than the wall mounting screws 900, 902, 904 and the fasteners 180, 182, 184 used with the adapter in the first embodiment illustrated in FIGS. 1 and 2. Alternatively, the bracket mounting screws 950, 952, 954 could extend beyond the adapter 100 and engage the wall to further secure the bracket 150 and the adapter 100 to the wall.

It will be appreciated that this second configuration allows the user to first position the adapter 100 on the wall in a desired or required location, and then secure the handrail to the adapter 100 in a separate operation.

In one embodiment, the first, second and third bracket mounting bores 318*a*, 318*b*, 318*c* are threaded to threadably receive the bracket mounting screws 950, 952, 954. Alternatively, instead of the first, second and third bracket mounting bores 318*a*, 318*b*, 318*c* being threaded, the first, second and third bracket mounting bores 318*a*, 318*b*, 318*c* could be unthreaded and the bracket mounting screws 950, 952, 954 could be self-tapping screws. Specifically, the body 300 could be made of a material adapted to receive self-tapping screws, such as a plastic, and the self-tapping screws could be sized and shaped to create threads in the unthreaded first, second and third bracket mounting bores 318*a*, 318*b*, 318*c* as the bracket mounting screws 950, 952, 954 are screwed into their respective bore to thereby secure the bracket 150 to the adapter 100.

Referring back once again to FIGS. 3 to 8B, the body 300 further includes a central counterbored hole 350 generally centered on the front face 310 and extending through the front face 310. As shown more precisely in FIG. 8B, the central counterbored hole 350 is generally similar to the first, second and third counterbored holes 316*a*, 316*b*, 316*c*, albeit slightly larger. Specifically, the central counterbored hole 350 includes a cylindrical recess 850 extending from the front face 310 towards the rear face 402 of the adapter 100 and a bore 852 extending from the cylindrical recess 850, away from the front face 310.

Figure 11:
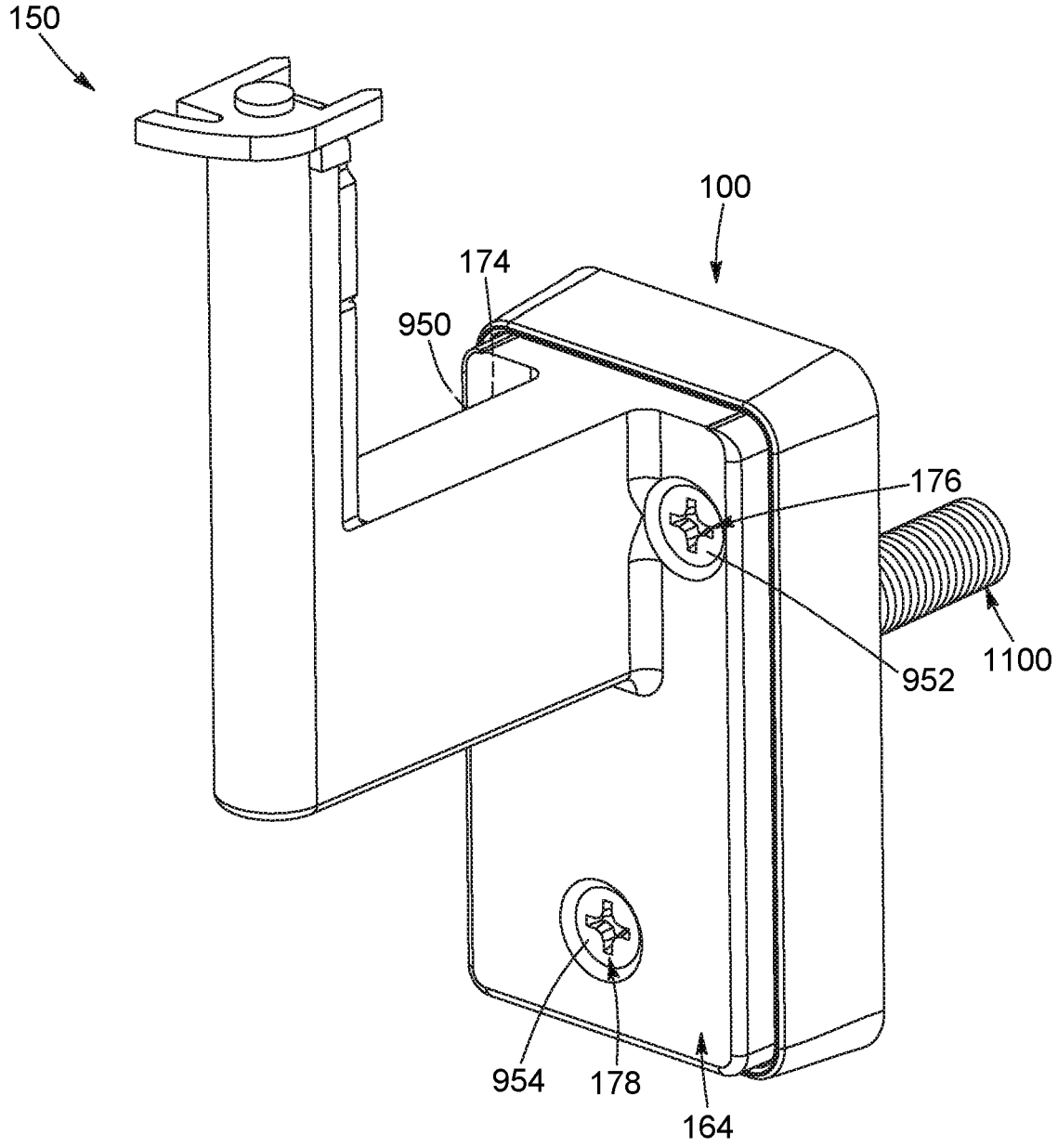
FIG. 11 is a top front perspective view of the handrail wall mount adapter illustrated in FIG. 1, with the adapter connected to a handrail wall mount bracket and shown in a third configuration in which the adapter is adapted to be connected to a wall using a single central wall mounting fastener.
Figure 12:
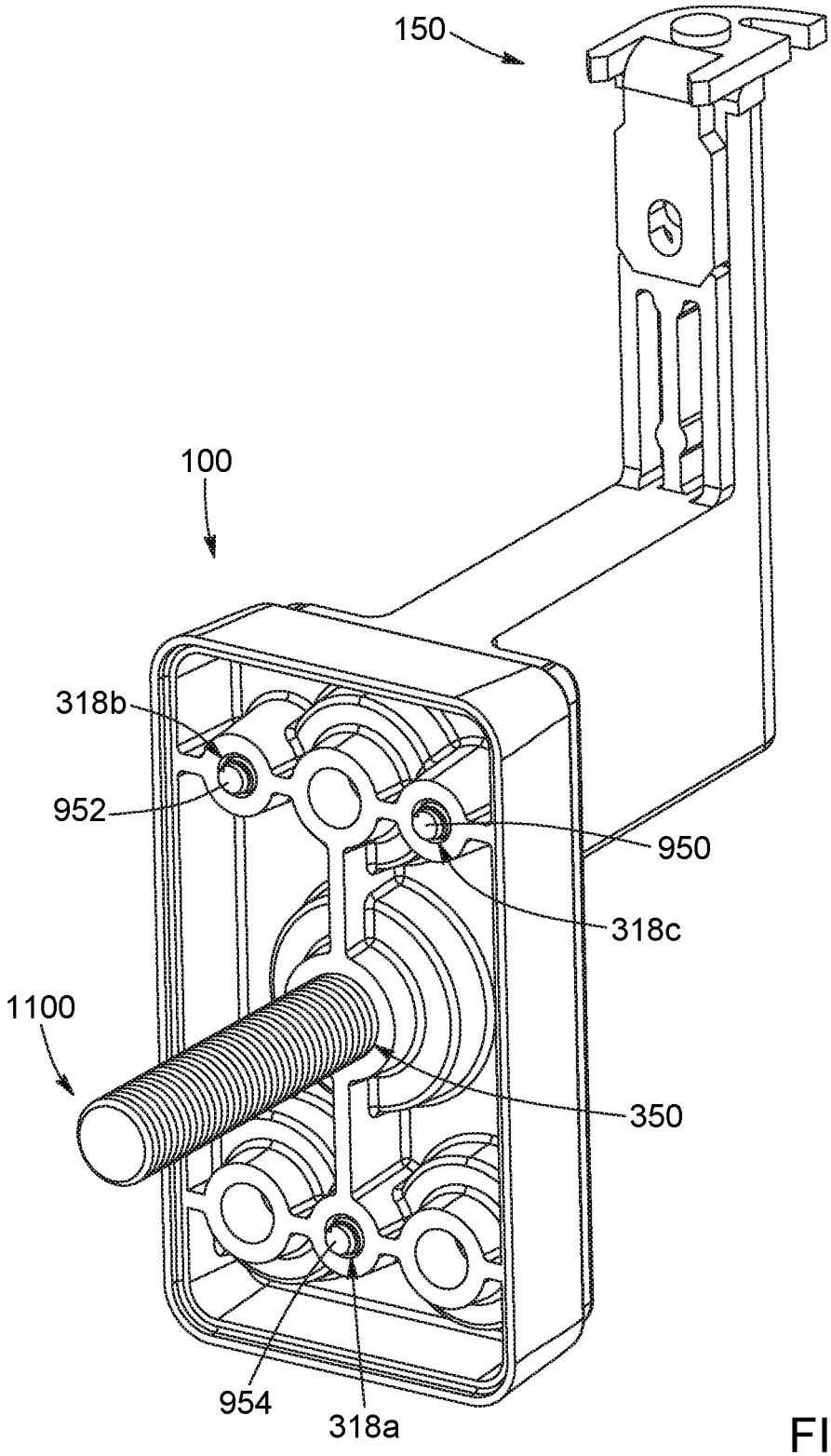
FIG. 12 is a top rear perspective view of the handrail wall mount adapter illustrated in FIG. 11, with the adapter still connected to the handrail wall mount bracket and still shown in the third configuration.

Turning now to FIGS. 11 and 12, the adapter 100 is shown assembled with the bracket 150 and the adapter 100 is shown ready to be mounted to the wall in a third configuration. In this third configuration, the adapter 100 is oriented similarly to the second configuration, with the first vertical side wall 306 disposed to the right of the second vertical side wall 308 and the first horizontal wall 302 disposed below the second horizontal wall 304.

In this third configuration, the adapter 100 is secured to the wall using a single central wall mounting fastener 1100, which is sized and shaped to be received in the central counterbored hole 350 of the adapter 100 and is adapted to engage the wall. In one embodiment, the central wall mounting fastener 1100 could be a screw adapted to directly penetrate a surface of the wall when screwed into the wall. Alternatively, the central wall mounting fastener 1100 could include a bolt adapted to engage a pre-drilled and pre-threaded bore defined in the wall or in another similar structure.

In addition to the configurations illustrated in FIGS. 1 to 12 and described above, the adapter 100 could also be configured in one of various configurations in which the adapter 100 is secured to the wall using a combination of different types of fasteners. For example, the adapter 100 could be secured to the wall using a central fastener similar to the central wall mounting fastener 1100 illustrated in FIGS. 11 and 12, as well as one or more fasteners similar to fasteners 180, 182 extending through corresponding counterbored hole 316*a*, 316*b*, 316*c* of the adapter 100.

Figure 13:
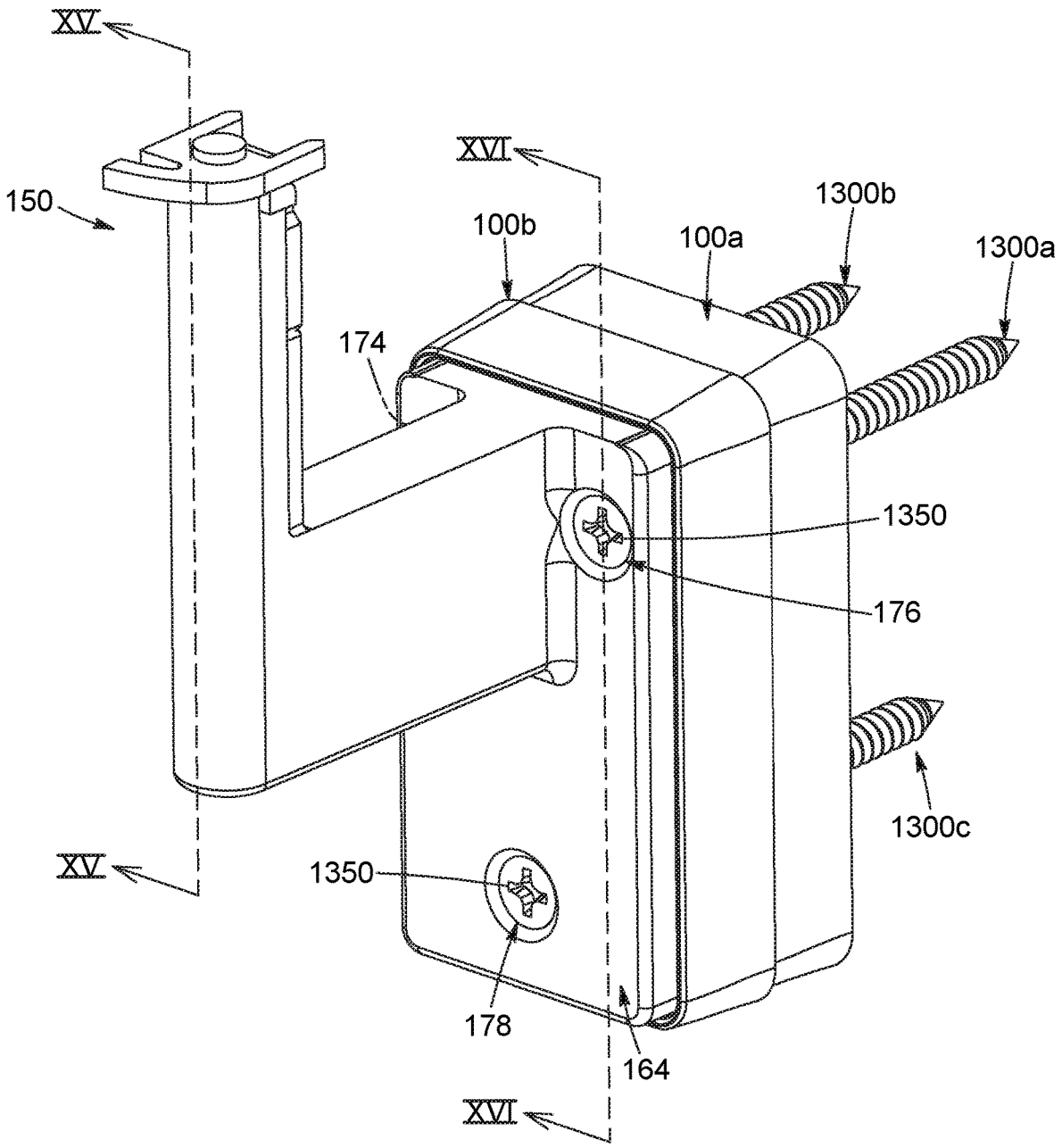
FIG. 13 is a top front perspective view of a first and second handrail wall mount adapters similar to the handrail wall mount adapter illustrated in FIG. 1, with the second adapter mounted between the first adapter and a handrail wall mount bracket and with the first adapter in the first configuration illustrated in FIG. 1 and the second adapter in the second configuration illustrated in FIG. 9.
Figure 14:
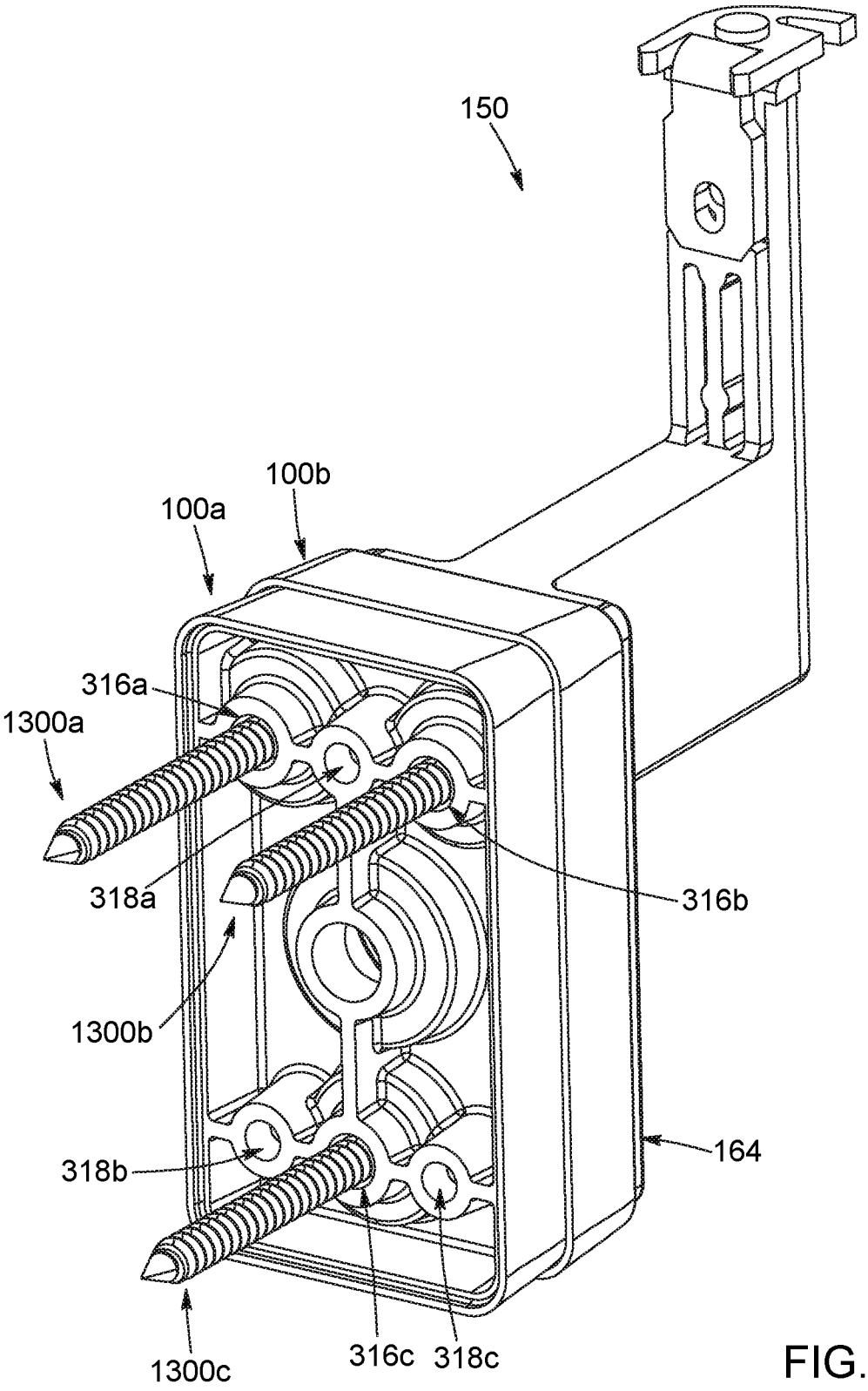
FIG. 14 is a top rear perspective view of the first and second handrail wall mount adapters illustrated in FIG. 13.
Figure 15:
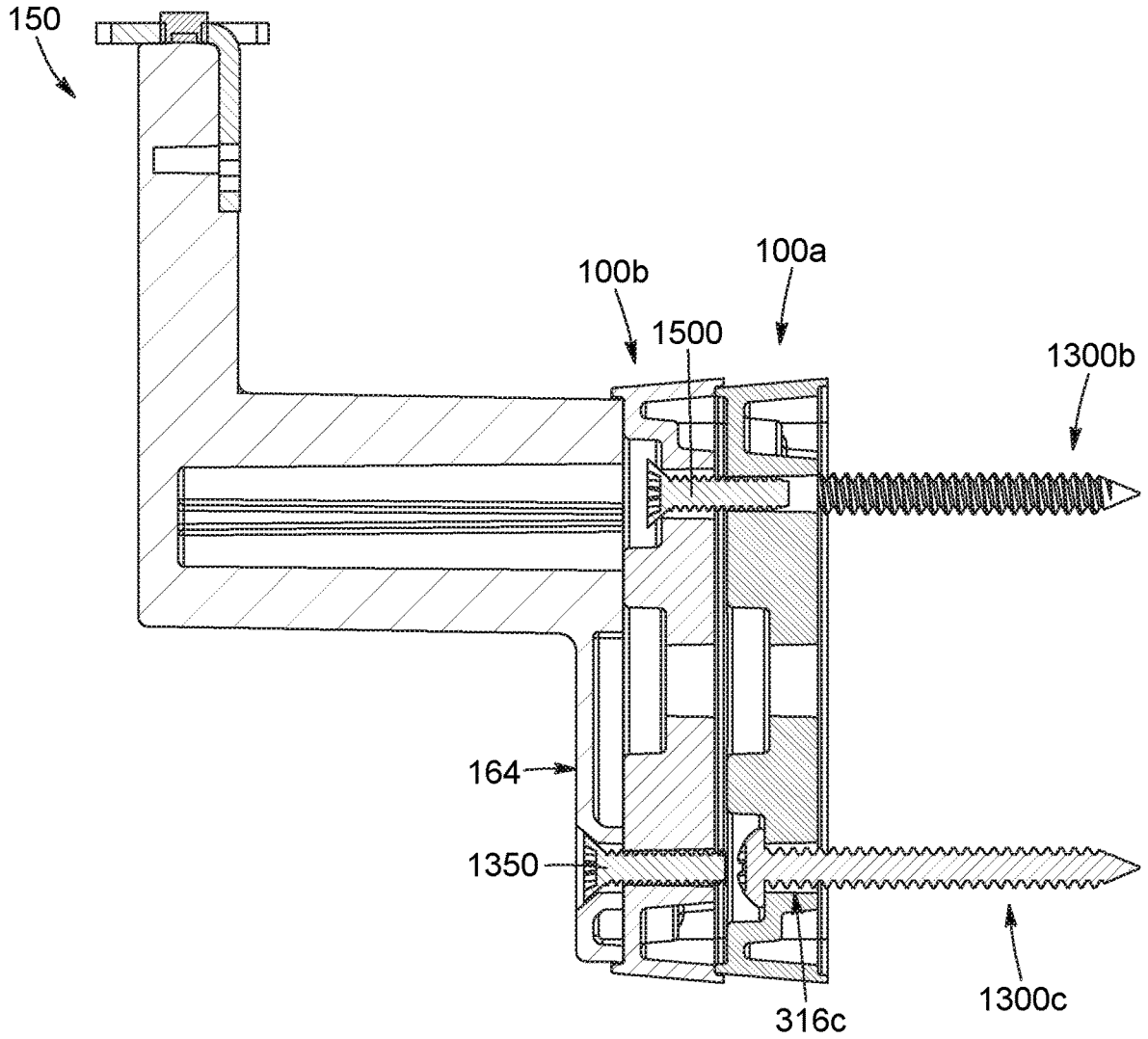
FIG. 15 is a cross-section view, taken along line XV-XV, of the first and second handrail wall mount adapters illustrated in FIG. 13.
Figure 16:
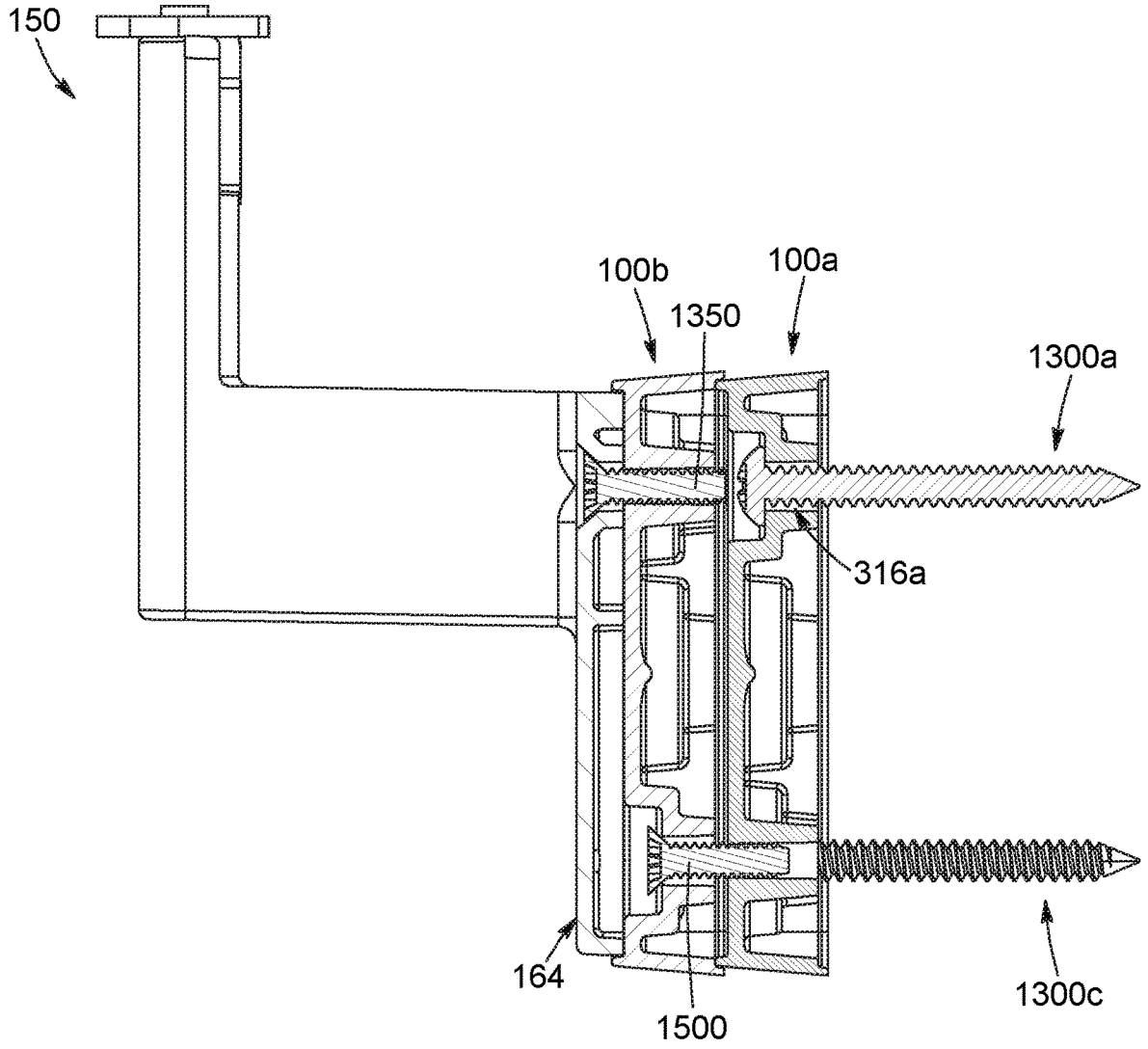
FIG. 16 is another cross-section view, taken along line XVI-XVI, of the first and second handrail wall mount adapters illustrated in FIG. 13.

Referring now to FIGS. 13 to 15, there is shown a first handrail wall mount adapter 100*a* and a second handrail wall mount adapter 100*b* both used to mount the bracket 150 to the wall. Both the first and the second handrail wall mount adapters 100*a*, 100*b* are similar to the adapter 100 illustrated in FIGS. 1 to 12 and described above.

In this embodiment, the first and second adapters 100*a*, 100*b* are stacked over each other. As explained above, the first and second horizontal walls 302, 304 are not parallel to each other, but are instead angled towards each other from the rear face 402 towards the front face 310. Similarly, the first and second vertical side walls 306, 308 are not parallel to each other, but are instead angled towards each other from the rear face 402 towards the front face 310. In this configuration, the front face 310 of the first adapter 100*a* can be received in the second adapter 100*b* through the open rear face 402 of the second adapter 100*b*. Specifically, the front face 310 of the first adapter 100*a* can be inserted into the rear face 402 of the second adapter 100*b*, past the rear peripheral edge 404 of the second adapter 100*b*, until the front peripheral edge 312 of the first adapter 100*a* abuts the rear lip 406 of the second adapter 100*b*. The first adapter 100*a* is therefore held between the second adapter 100*b* and the wall and is thereby prevented from moving horizontally. Furthermore, since the front face 310 of the first adapter 100*a* extends into the body 300 of the second adapter 100*b* beyond the rear peripheral edge 404 of the second adapter 100*b*, the first adapter 100*a* is further prevented from moving out of alignment with the second adapter 100*b* by the horizontal and vertical sidewalls 302, 304, 306, 308 of the second adapter 100*b*.

In this embodiment, the bracket 150 can be secured to the wall according to one of various arrangements. In the arrangement illustrated in FIGS. 13 to 16, the first adapter 100*a* is placed against the wall in the first configuration as shown in FIGS. 1 and 2 and the second adapter 100*b* is placed over the first adapter 100*a* in the second configuration as shown in FIGS. 9 and 10. In this arrangement, the first, second and third counterbored holes 316*a*, 316*b*, 316*c* of the second adapter 100*b* are aligned respectively with the third, second and first bracket mounting bores 318*c*, 318*b*, 318*a* of the first adapter 100*a*.

To mount the bracket 150 and the first and second adapters 100*a*, 100*b* to the wall, the first adapter 100*a* is first placed against the wall in a desired location. Wall mounting screws 1300*a*, 1300*b*, 1300*c* are then inserted into the first, second and third counterbored holes 316*a*, 316*b*, 316*c* of the first adapter 100*a* and through the wall to secure the first adapter 100*a* to the wall.

The second adapter 100*b* is then placed over the first adapter 100*a* in the second configuration such that the front peripheral edge 312 of the first adapter 100*a* abuts the rear lip 406 of the second adapter 100*b*. The rear lip is configured such that when the front peripheral edge of the first adapter 100*a* abuts the rear lip of the second adapter 100*b*, the second adapter 100*b* is generally parallel to the first adapter 100*a*. Alternatively, the second adapter 100*b* may not include a rear lip 406, and the front peripheral edge 312 of the first adapter 100*a* could simply abut the inside of the horizontal walls 302, 304 and the vertical side walls 306, 308 of the second adapter 100*b* as the distance between the horizontal walls 302, 304 and between the vertical side walls 306, 308 of the second adapter 100*b* gets progressively smaller from the rear face 404 to the front face 310.

The second adapter 100*b* can then be secured to the first adapter 100*a* by a plurality of adapter mounting screws 1500 which are each inserted in one of the counterbored holes 316*a*, 316*b*, 316*c* of the second adapter 100*b* and threadably engage the corresponding bracket mounting bore 318*a*, 318*b* or 318*c* of the first adapter 100*a* aligned with the counterbored hole. The adapter mounting screws 1500 can be inserted by rotating the screws 1500 until the head of the screws 1500 abut the second adapter 100*b*, thereby securing the second adapter 100*b* to the first adapter 100*a*.

The bracket 150 can then be placed against the second adapter 100*b* such that the mounting plate 164 of the bracket 150 is received in the front recess 312 of the second adapter 100*b*. Since the second adapter 100*b* is in the second configuration illustrated in FIGS. 9 and 10, the top left, top right and bottom mounting holes 174, 176, 178 of the mounting plate 164 are respectively aligned with the third, second and first bracket mounting bores 318*c*, 318*b*, 318*a* of the second adapter 100*b*. The bracket 150 can then be secured by a plurality of bracket mounting screws 1350 passing through the top left, top right and bottom mounting holes 174, 176, 178 of the mounting plate 164 and threadably engaging the third, second and first bracket mounting bores 318*c*, 318*b*, 318*a* of the second adapter 100*b* as described above with reference to FIGS. 9 and 10.

It will be understood that instead of the above-described arrangement, the bracket 150 and the first and second adapters 100*a*, 100*b* could be mounted to the wall using one of various alternative arrangements.

For example, the bracket 150 and the first and second adapters 100*a*, 100*b* could instead be mounted to the wall using only first, second and third wall mounting fasteners, similar to the first, second and third wall mounting fasteners 180, 182, 184 used to secured the adapter 100 to the wall in the first configuration illustrated in FIGS. 1 and 2. Specifically, to secure the first and second adapters 100*a*, 100*b* to the wall, the first adapter 100*a* is oriented in the first configuration shown in FIGS. 1 and 2 and is placed in abutment with the wall at a desired location, the second adapter 100*b* is stacked over the first adapter 100*a* as described above, but in the first configuration rather than the second configuration shown in FIGS. 9 and 10. In this configuration, the first, second and third counterbored holes 316*a*, 316*b*, 316*c* of the second adapter 100*b* are aligned with the first, second and third counterbored holes 316*a*, 316*b*, 316*c* of the first adapter 100*a*. When the mounting plate 164 of the bracket 150 is received in the front recess 312 of the second adapter 100*b*, the top left, top right and bottom mounting holes 174, 176, 178 of the mounting plate 164 are also aligned with the first, second and third counterbored holes 316*a*, 316*b*, 316*c* of the first and second adapters 100*a*, 100*b*. The first, second and third wall mounting fasteners can then be inserted into the top left, top right and bottom mounting holes 174, 176, 178 of the mounting plate 164 and further into the first, second and third counterbored holes 316*a*, 316*b*, 316*c* of the first and second adapters 100*a*, 100*b* until they engage the wall, thereby securing the bracket 150 and the first and second adapters 100*a*, 100*b* to the wall.

It will be appreciated that in the above embodiment, the second adapter 100*b* stacked over the first adapter 100*a* allows the handrail to be spaced further away from the wall than if a single adapter 100 were used. Alternatively, more than two adapters 100 may be used and stacked over each other in one of various arrangements to further space the handrail from the wall if desired and/or required.

It will further be appreciated that the adapter 100 described above allows the bracket 150 to be secured to the wall using various types of fasteners.

Furthermore, the adapter 100 further serves to increase the spacing between the handrail and the wall. By using multiple adapters stacked over each other, the spacing between the handrail and the wall can be further increased.

It will be further appreciated that the arrangements described above are merely provided as examples, and that many alternative configurations may be considered. For example, the adapter 100 described above could have one of various alternative shape and have a different number of holes and/or holes which are disposed at different locations, depending on the configuration of the handrail wall mounting bracket 150.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A handrail wall mount adapter for mounting a handrail wall mounting bracket of a handrail assembly to a wall, the bracket including a mounting plate having a plurality of mounting openings extending therethrough, the adapter comprising:

a body having a front face configured for matingly receiving the mounting plate and a rear face for abutting the wall, the body further having at least one unthreaded opening extending between the front face and the rear face of the body, each unthreaded opening being configured for receiving a wall mounting fastener therethrough, the body further having a plurality of bracket mounting openings defined in the front face for receiving at least one bracket mounting fastener, the body being selectively positionable relative to the mounting plate in a first orientation in which the at least one unthreaded opening is aligned with the mounting openings of the mounting plate to allow the wall mounting fasteners to extend through the mounting openings and through the unthreaded openings and securely engage the wall, and in a second orientation in which the bracket mounting openings are aligned with the mounting openings of the mounting plate to allow the bracket mounting fasteners to extend through the mounting openings and the bracket mounting openings to thereby secure the mounting bracket to the adapter, wherein the body further includes a body sidewall extending between the front and rear faces, the body sidewall being tapered from the rear face towards the front face, wherein the body is hollow, wherein the front face of the body is closed and the rear face is open, wherein the body further includes a rear peripheral edge facing away from the front face for abutting the wall, and wherein the body further includes a rear lip extending along the inside of the body sidewall near the rear peripheral edge, the rear lip being configured for abutting a front peripheral edge of an additional adapter to allow the adapter to be stacked over the additional adapter.

2. The adapter as claimed in claim 1, wherein each bracket mounting opening includes a threaded bore to threadably receive the bracket mounting fasteners.

3. The adapter as claimed in claim 1, wherein the bracket mounting openings are unthreaded and the bracket mounting fasteners include self-tapping screws which create threads in the bracket mounting openings when screwed therein.

4. The adapter as claimed in claim 1, wherein the at least one unthreaded opening includes a plurality of off-centered unthreaded holes disposed around a center of the front face.

5. The adapter as claimed in claim 4, wherein the plurality of off-centered unthreaded holes includes first, second and third off-centered unthreaded holes.

6. The adapter as claimed in claim 5, wherein the at least one unthreaded opening includes a central unthreaded hole centered on the front face.

7. The adapter as claimed in claim 6, wherein the first, second and third off-centered unthreaded holes have the same diameter and the central unthreaded hole has a diameter larger than the diameter of the off-centered unthreaded holes.

8. The adapter as claimed in claim 1, wherein each unthreaded opening is counterbored.

9. The adapter as claimed in claim 8, wherein each unthreaded opening includes a cylindrical recess extending from the front face towards the rear face and a bore extending from the cylindrical recess towards the rear face.

10. The adapter as claimed in claim 1, wherein the body further includes a front recess which extends into the body from the front face towards the rear face and which defines a front peripheral edge surrounding the front recess, the front recess being sized and shaped to receive the mounting plate.

11. The adapter as claimed in claim 1, wherein the body is rectangular.

12. A kit for mounting a handrail wall mounting bracket of a handrail assembly to a wall, the bracket including a mounting plate having a plurality of mounting openings extending therethrough, the kit comprising:

a first handrail wall mount adapter; and a second handrail wall mount adapter, each of said first and second handrail wall mount adapters comprising a body having a front face configured for matingly receiving the mounting plate and a rear face for abutting the wall, the body further having at least one unthreaded opening extending between the front face and the rear face of the body, each unthreaded opening being configured for receiving a wall mounting fastener therethrough, the body further having a plurality of bracket mounting openings defined in the front face for receiving at least one bracket mounting fastener, the body being selectively positionable relative to the mounting plate in a first orientation in which the at least one unthreaded opening is aligned with the mounting openings of the mounting plate to allow the wall mounting fasteners to extend through the mounting openings and through the unthreaded openings and securely engage the wall, and in a second orientation in which the bracket mounting openings are aligned with the mounting openings of the mounting plate to allow the bracket mounting fasteners to extend through the mounting openings and the bracket mounting openings to thereby secure the mounting bracket to the adapter, the second handrail wall mount adapter being selectively stackable over the first handrail wall mount adapter such that the rear face of the second handrail wall mount adapter engages the front face of the first handrail wall mount adapter and each unthreaded openings of the second handrail wall mount adapter is aligned with a corresponding bracket mounting opening of the first handrail wall mount adapter to receive a corresponding adapter mounting screw therethrough.

13. The kit as claimed in claim 12, wherein the body of each one of the first and second handrail wall mount adapters further includes a body sidewall extending between the front and rear faces of the corresponding body, the body sidewall being tapered from the rear face towards the front face.

14. The kit as claimed in claim 13, wherein the body of the second handrail wall mount adapter includes a rear peripheral edge facing away from the front face for abutting the wall and a rear lip extending along the inside of the body sidewall near the rear peripheral edge, the rear lip being configured for abutting a front peripheral edge of the first handrail wall mount adapter.

15. The kit as claimed in claim 12, wherein each bracket mounting opening includes a threaded bore to threadably receive a corresponding one of the bracket mounting fasteners.

16. The kit as claimed in claim 12, wherein the bracket mounting openings are threaded and unthreaded and the bracket mounting fasteners include self-tapping screws which create threads in the bracket mounting openings when screwed therein.

17. The kit as claimed in claim 16, wherein the at least one unthreaded opening includes a plurality of off-centered unthreaded holes disposed around a center of the front face.

18. The kit as claimed in claim 17, wherein the plurality of off-centered unthreaded holes includes first, second and third off-centered unthreaded holes.

19. The kit as claimed in claim 18, wherein the at least one unthreaded opening includes a central unthreaded hole centered on the front face.

20. The kit as claimed in claim 19, wherein the first, second and third off-centered unthreaded holes have the same diameter and the central unthreaded hole has a diameter larger than the diameter of the off-centered unthreaded holes.

* * * * *